US008359955B2

(12) United States Patent
Deneault

(10) Patent No.: US 8,359,955 B2
(45) Date of Patent: Jan. 29, 2013

(54) TORQUE SOCKET

(76) Inventor: Francois Deneault, Mascouche (CA)

( * ) Notice: Subject to any disclaimer, the term of this patent is extended or adjusted under 35 U.S.C. 154(b) by 189 days.

(21) Appl. No.: 13/051,364

(22) Filed: Mar. 18, 2011

(65) Prior Publication Data

US 2011/0232431 A1 Sep. 29, 2011

(30) Foreign Application Priority Data

Mar. 23, 2010 (GB) ..... 1004839.5

(51) Int. Cl.
*B25B 23/157* (2006.01)

(52) U.S. Cl. ..... 81/474; 81/473

(58) Field of Classification Search ..... 81/473–477
See application file for complete search history.

(56) References Cited

U.S. PATENT DOCUMENTS

| | | | | | |
|---|---|---|---|---|---|
| 1,566,553 | A | | 12/1925 | Maisch | |
| 2,527,517 | A | | 10/1950 | Barker et al. | |
| 2,708,836 | A | | 5/1955 | Stuart | |
| 3,068,667 | A | | 12/1962 | Sussman | |
| 3,167,936 | A | | 2/1965 | Engquist | |
| 3,441,115 | A | | 4/1969 | Gunther | |
| 3,595,105 | A | * | 7/1971 | Wagner | 81/474 |
| 3,662,628 | A | | 5/1972 | Schnepel | |
| 3,667,250 | A | | 6/1972 | Schnepel | |
| 3,695,059 | A | | 10/1972 | Laubach | |
| 3,702,546 | A | * | 11/1972 | Schnepel | 464/36 |
| 3,889,490 | A | | 6/1975 | Nadolny | |
| 3,942,337 | A | | 3/1976 | Leonard et al. | |
| 4,262,501 | A | * | 4/1981 | Vaughn et al. | 464/36 |
| 4,272,973 | A | | 6/1981 | Fu-Tsai | |
| 5,437,524 | A | * | 8/1995 | Huang | 408/139 |
| 5,535,867 | A | | 7/1996 | Coccaro et al. | |
| 6,132,435 | A | * | 10/2000 | Young | 606/104 |
| 6,832,533 | B1 | * | 12/2004 | Huang | 81/475 |
| 7,032,476 | B2 | * | 4/2006 | Lin | 81/58.3 |
| 7,318,691 | B2 | | 1/2008 | Osburn | |
| 7,475,619 | B2 | | 1/2009 | Chiu et al. | |
| 8,161,849 | B2 | * | 4/2012 | Stark | 81/473 |
| 2011/0061500 | A1 | * | 3/2011 | Huang | 81/474 |
| 2011/0094354 | A1 | * | 4/2011 | Lai | 81/475 |

* cited by examiner

*Primary Examiner* — David B Thomas

(57) ABSTRACT

A torque socket has an outer cylinder having markings on an outer surface thereof. A receptacle including a male ratchet member at one distal end, and a plurality of cavities and a central channel at an opposite end. A plurality of balls each adapted to fit within a respective cavity of the receptacle. A spring seat including a release pad, a central pin extending axially therefrom from one end and adapted to fit within the central channel of the receptacle, thereby holding the balls within the cavities, and a disk at an opposite end. A coiled spring received upon the spring seat. A cylinder head having a female ratchet portion, and is adapted to compress the coiled spring and releasably and adjustably attach to an inside surface of the outer cylinder, thereby holding the receptacle, the balls, and the spring seat together and between the outer cylinder and the cylinder head.

10 Claims, 5 Drawing Sheets

10

TORQUE SOCKET

FIELD OF THE INVENTION

The present invention relates generally to ratchet sockets but more particularly to a ratchet socket having a means to control tightening torque.

BACKGROUND OF THE INVENTION

Ratchet sockets are well known in the art and so are torque wrenches but the latter are rather specialized tools that few would think about buying because of costs.

SUMMARY OF THE INVENTION

In view of the foregoing disadvantages inherent in the known devices now present in the prior art, the present invention, which will be described subsequently in greater detail, is to provide objects and advantages which are:

To provide for a socket that has torque calibration built in.

To attain these ends, the present invention generally consists in an adapter that fits between the ratchet socket handle and the socket that is usually inserted. The torque socket has an outer cylinder having markings on an outer surface thereof. A receptacle including a male ratchet member at one distal end, and a plurality of cavities and a central channel at an opposite end. A plurality of balls each adapted to fit within a respective cavity of the receptacle. A spring seat including a release pad, a central pin extending axially therefrom from one end and adapted to fit within the central channel of the receptacle, thereby holding the balls within the cavities, and a disk at an opposite end. A coiled spring received upon the spring seat. A cylinder head having a female ratchet portion, and is adapted to compress the coiled spring and releasably and adjustably attach to an inside surface of the outer cylinder, thereby holding the receptacle, the balls, and the spring seat together and between the outer cylinder and the cylinder head. A locking ring releasably and adjustably attach to an outer surface of the cylinder head and adapted to limit the distance the cylinder head can be placed within the outer cylinder. A calibration ring releasably and adjustably attached to an outer surface of the cylinder head and having an indicium on an outside surface thereof and adapted to correlate to a chosen one of the outer cylinder markings, such that the torque socket is adapted to be fit between a ratchet tool and a ratchet socket to thereby adapt the ratchet tool to offer a means for ratchet torque control.

The torque socket has the releasable and adjustable connection between the outer cylinder and the cylinder head include interdigitating threads. And the releasable and adjustable connection between the outer cylinder and the calibration ring also include interdigitating threads.

The torque socket has the releasable and adjustable connection between the outer cylinder and the calibration ring include a set screw.

The torque socket has the amount of tension the spring applies onto the release pad control the amount of torque desired, wherein the tension is achieved by the distance the outer cylinder is threaded into the cylinder head, such that the markings on the outer cylinder are adapted to line up with a chosen mark on the calibration ring, and wherein the locking ring locks in the desired torque.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

DETAILED DESCRIPTION OF THE PREFERRED EMBODIMENT

Figure 1:
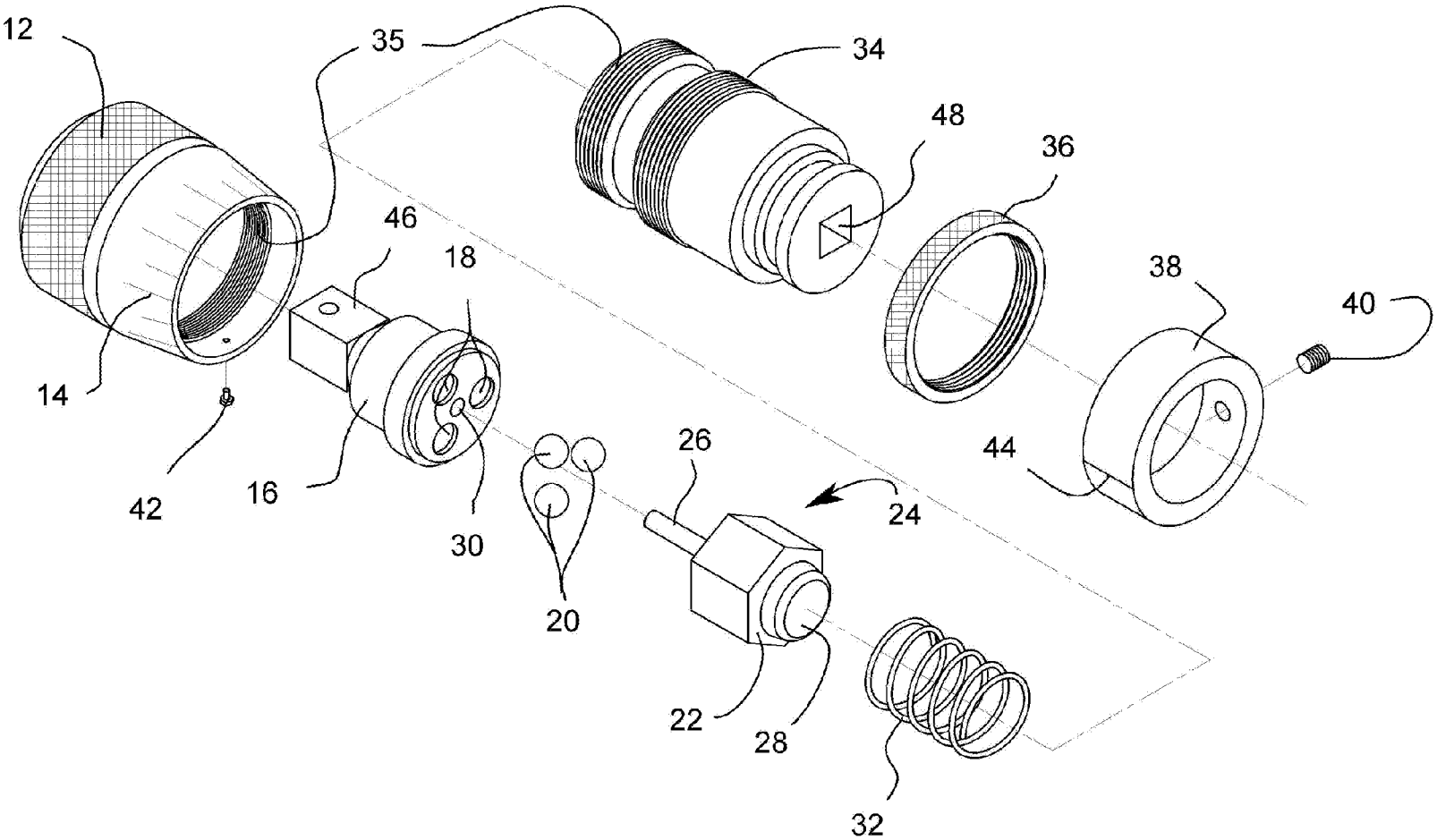
FIG. 1 Exploded isometric view of the invention.
Figure 2A:
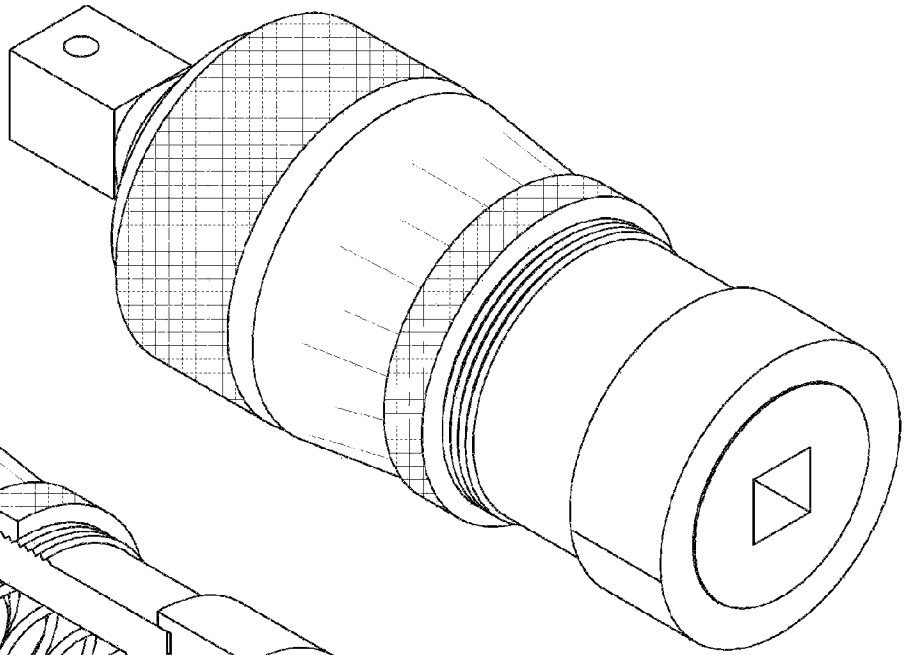
FIGS. 2*a-b* Isometric view and cutaway isometric view of the invention.
Figure 2B:
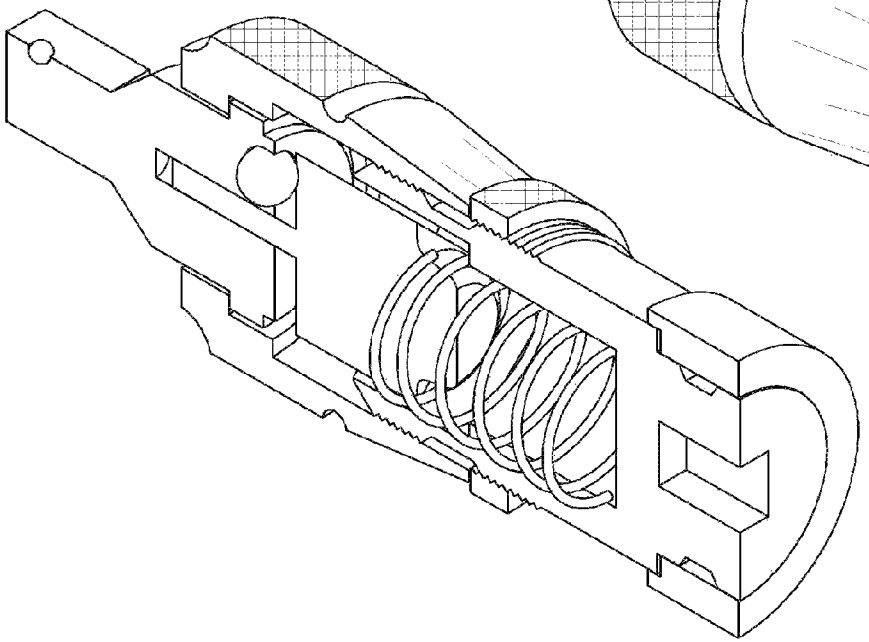
Figure 3B:
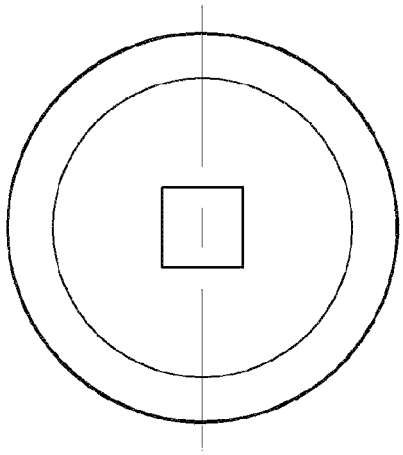
FIGS. 3*a-b* Side and end views, respectively.
Figure 3A:
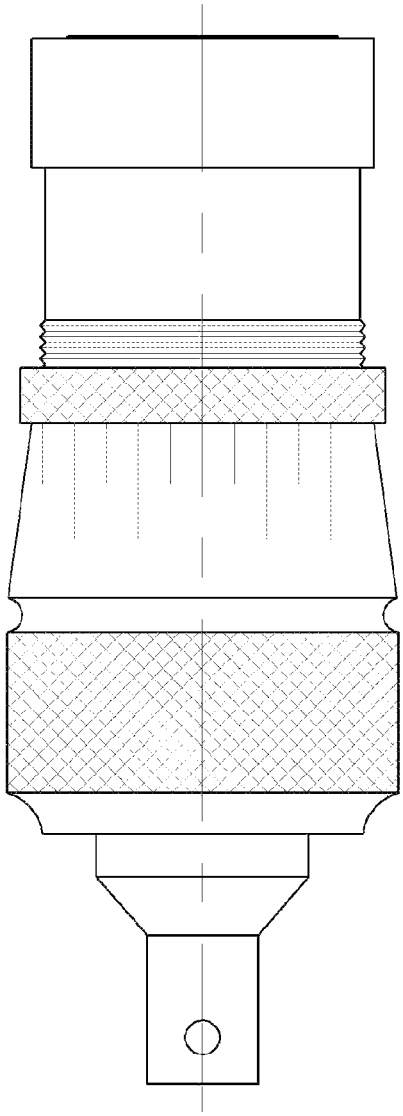
Figure 4:
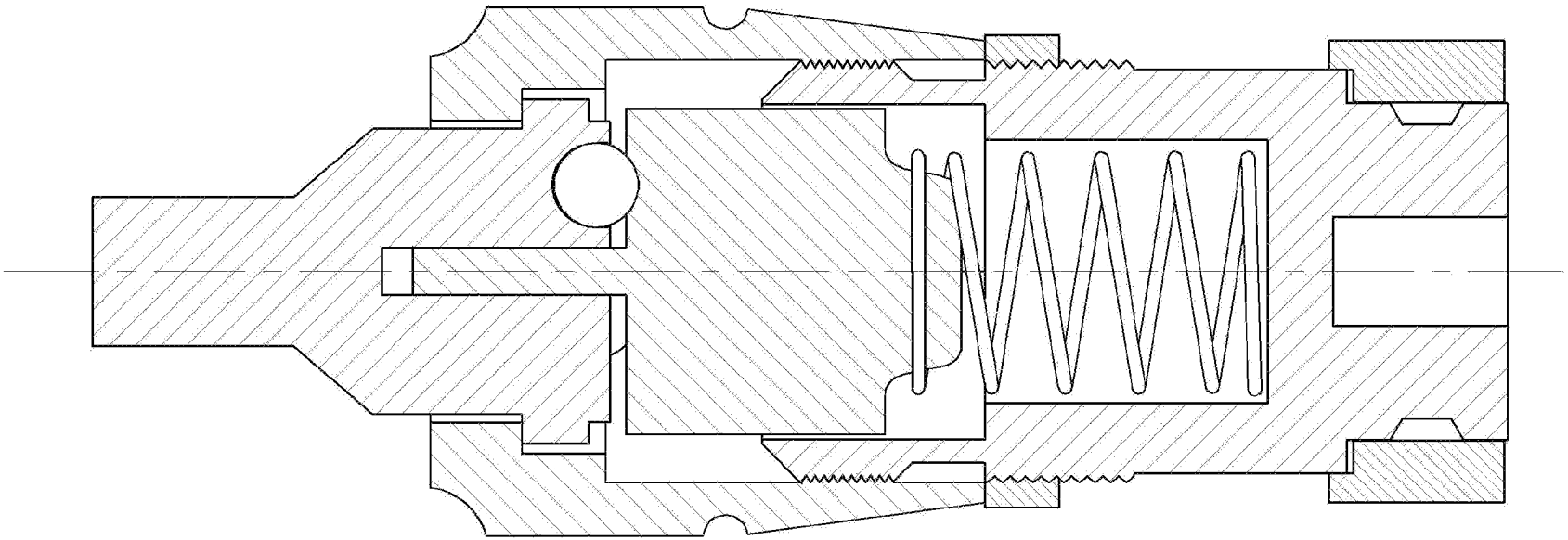
FIG. 4 Cutaway side view.
Figure 5:
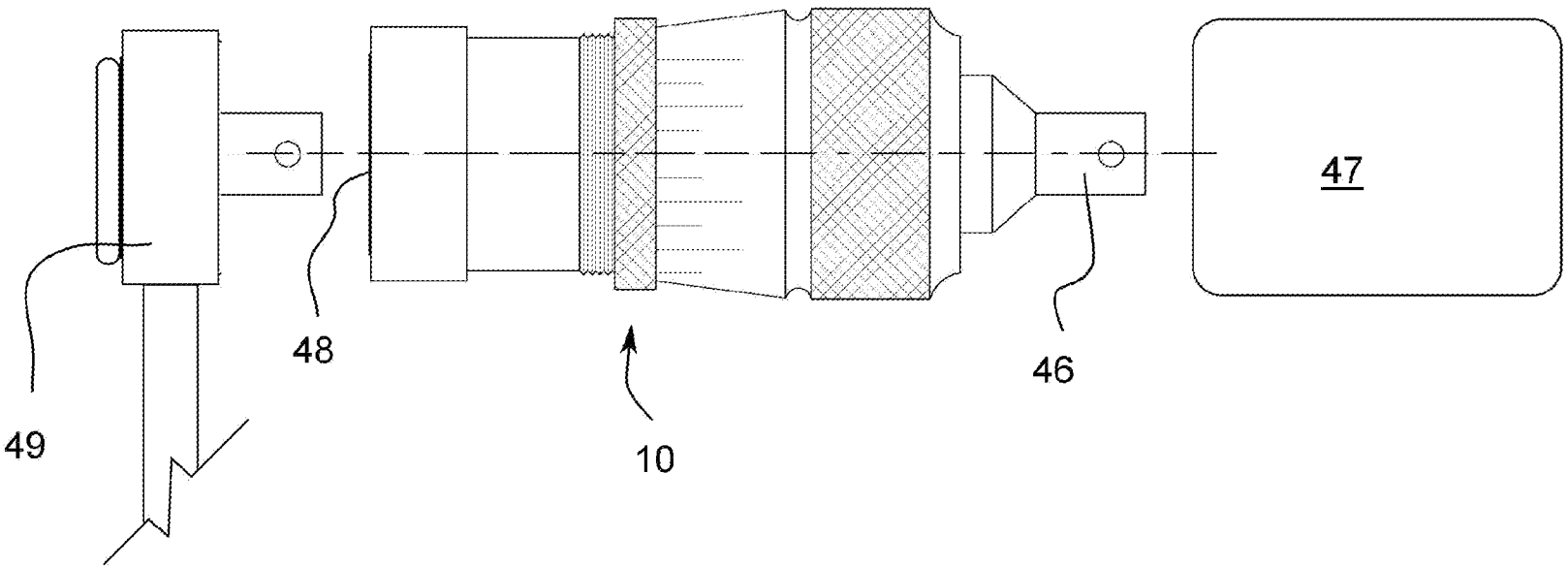
FIG. 5 Side view of the invention as it relates to a socket handle and a socket.

A torque socket (10) has an outer cylinder (12) having markings (14) that slips around a receptacle (16) and a cylinder head (34). The cylinder has a cylinder lock screw (42) to lock in the cylinder head (34). The receptacle (16) has a plurality of cavities (18) configured and sized to receive a plurality of balls (20) inserted between the receptacle (16) and a release pad (22). A spring seat (24) has a central pin (26) and a disc (28) and wherein the central pin (26) is inserted into a central channel (30) bored through the receptacle (16). The disc (28) receives a coiled spring (32) and is compressed by way of the cylinder head (34). A locking ring (36) and a calibration ring (38) having a set screw (40). A male ratchet member (46) is used for connecting with a socket (47) and a female ratchet portion (48) is used to connect with a ratchet tool (49). The ratchet tool (49) and the socket (47) are known in the art and need not be further discussed herein.

The cylinder head (34) is threadably attached to the outer cylinder (12) by way of interdigitating threads (35) located on the inner face of the outer cylinder (12) and on the outer face of the cylinder head (34). The amount of tension the spring (32) applies onto the release pad (22) controls the amount of torque desired. The tension is achieved by how much the outer cylinder (12) is threaded around the cylinder head (34). The locking ring (36) locks the desired torque. The markings (14) on the outer cylinder line up with an indicium (44) on the calibration ring (38). The invention can also be used with an air powered impact gun, electric ratchet, or any such tool known in the art.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A torque socket for use with a ratchet tool, said torque socket comprising an outer cylinder having markings on an outer surface thereof; a receptacle including a male ratchet member at one distal end, and a plurality of cavities and a central channel at an opposite end; a plurality of balls each adapted to fit within a respective cavity of said receptacle; a spring seat including a release pad, a central pin extending axially therefrom from one end and adapted to fit within said central channel of said receptacle, thereby holding said balls within said cavities, and a disk at an opposite end; a coiled spring received upon said spring seat; a cylinder head having a female ratchet portion, and is adapted to compress said coiled spring and releasably and adjustably attach to an inside surface of said outer cylinder, thereby holding said receptacle, said balls, and said spring seat together and between said outer cylinder and said cylinder head; a locking ring releasably and adjustably attach to an outer surface of said cylinder head and adapted to limit the distance said cylinder head can be placed within said outer cylinder; a calibration ring releasably and adjustably attached to an outer surface of said cylinder head and having an indicium on an outside surface thereof and adapted to correlate to a chosen one of said outer cylinder markings, such that said torque socket is adapted to be fit between a ratchet tool and a ratchet socket to thereby adapt said ratchet tool to offer a means for ratchet torque control.

2. The torque socket of claim 1, wherein said releasable and adjustable connection between said outer cylinder and said cylinder head includes interdigitating threads.

3. The torque socket of claim 1, wherein said releasable and adjustable connection between said outer cylinder and said calibration ring includes interdigitating threads.

4. The torque socket of claim 1, wherein said releasable and adjustable connection between said outer cylinder and said calibration ring includes a set screw.

5. The torque socket of claim 1, wherein the amount of tension said spring applies onto said release pad controls the amount of torque desired, wherein the tension is achieved by the distance the outer cylinder is threaded into said cylinder head, such that the markings on the outer cylinder are adapted to line up with a chosen mark on the calibration ring, and wherein said locking ring locks in the desired torque.

6. A ratchet tool comprising a ratchet handle; a ratchet socket member; and a torque socket, wherein said torque socket comprises an outer cylinder having markings on an outer surface thereof; a receptacle including a male ratchet member at one distal end, and a plurality of cavities and a central channel at an opposite end; a plurality of balls each adapted to fit within a respective cavity of said receptacle; a spring seat including a release pad, a central pin extending axially therefrom from one end and adapted to fit within said central channel of said receptacle, thereby holding said balls within said cavities, and a disk at an opposite end; a coiled spring received upon said spring seat disk; a cylinder head having a female ratchet portion, and is adapted to compress said coiled spring and releasably and adjustably attach to an inside surface of said outer cylinder, thereby holding said receptacle, said balls, and said spring seat together and between said outer cylinder and said cylinder head; a locking ring releasably and adjustably attach to an outer surface of said cylinder head and adapted to limit the distance said cylinder head can be placed within said outer cylinder; a calibration ring releasably and adjustably attached to an outer surface of said cylinder head and having a marking on an outside surface thereof and adapted to correlate to a chosen one of said outer cylinder markings, such that said torque socket is adapted to be fit between said ratchet tool handle and said ratchet socket member to thereby adapt said ratchet tool to offer a means for ratchet torque control.

7. The torque socket of claim 6, wherein said releasable and adjustable connection between said outer cylinder and said cylinder head includes interdigitating threads.

8. The torque socket of claim 6, wherein said releasable and adjustable connection between said outer cylinder and said calibration ring includes interdigitating threads.

9. The torque socket of claim 6, wherein said releasable and adjustable connection between said outer cylinder and said calibration ring includes a set screw.

10. The torque socket of claim 6, wherein the amount of tension said spring applies onto said release pad controls the amount of torque desired, wherein the tension is achieved by the distance the outer cylinder is threaded into said cylinder head, such that the markings on the outer cylinder are adapted to line up with a chosen mark on the calibration ring, and wherein said locking ring locks in the desired torque.

* * * * *